United States Patent [19]

Amin

[11] 4,376,660

[45] Mar. 15, 1983

[54] METHOD FOR INDUCING SUPERPLASTIC PROPERTIES IN NONSUPERPLASTIC METAL AND ALLOY POWDERS

[75] Inventor: Kamal E. Amin, Columbia, Md.

[73] Assignee: The Bendix Corporation, Southfield, Mich.

[21] Appl. No.: 361,279

[22] Filed: Mar. 24, 1982

[51] Int. Cl.[3] ..... C22F 1/00

[52] U.S. Cl. ..... 148/11.5 P

[58] Field of Search ..... 148/11.5 P, 11.5 R, 148/11.5 C

[56] References Cited

U.S. PATENT DOCUMENTS 3,591,916 7/1971 Arthur ..... 148/11.5 R
3,649,375 3/1972 Venkatesan ..... 148/11.5 R
3,862,863 1/1975 Gervais et al. ..... 148/11.5 R
3,997,369 12/1976 Grimes et al. ..... 148/11.5 C

*Primary Examiner*—W. Stallard
*Attorney, Agent, or Firm*—James R. Ignatowski; Russel C. Wells

[57] ABSTRACT

A method for inducing superplastic properties in nonsuperplastic materials, metals or alloys, by mixing in powder form, the nonsuperplastic material with a second alloy having superplastic characteristics. The powder mixture is compacted into a billet and superplastically formed. The grain boundaries of the nonsuperplastic material are subsequently restored by heating the formed billet to a temperature slightly below the melting point of the second alloy.

27 Claims, 2 Drawing Figures

METHOD FOR INDUCING SUPERPLASTIC PROPERTIES IN NONSUPERPLASTIC METAL AND ALLOY POWDERS

CROSS REFERENCE

The disclosed invention is related to the commonly assigned co-pending application Ser. No. 361,280, Mar. 24, 1982, entitled "An Alternate Method for Inducing Superplastic Properties in Nonsuperplastic Metal and Alloy Powders" filed concurrently herewith.

BACKGROUND OF THE INVENTION

1. Field of the Invention

The invention is related to the field of powder metalurgy and in particular to a method for inducing superplastic properties in metals and alloys which have no superplastic properties.

2. Prior Art

Superplasticity is a property of certain alloys that allows them to be extensively deformed under appropriate conditions with very little stress. The prerequisite of superplastic alloys are defined by J. Wadsworth, T. Oyama and O. Sherby in their presentation "Superplasticity—Prerequisites and Phenomenology" at the *Inter-American Conference on Materials Technology,* Aug. 12–15, 1980, San Francisco, California, and by H. W. Hayden, R. C. Gibson and J. H. Broply in their article, "The Relationship Between Superplasticity and Formability", Metalurgical Society AIME, *Plenum Press,* 1971, pp. 475–497. Accordingly, for an alloy to exhibit superplasticity it should be of microduplex structure having a grain size of less than 10 micrometers, be either a eutectic or eutectoid composition, having a high strain rate sensitivity of flow stress and high angle grain boundaries.

A typical superplastic alloy is the nickel based alloy disclosed by Frecke et al in U.S. Pat. Nos. 3,702,791 and 3,775,101. Other superplastic alloys are described in the articles by J. Wadsworth et al and H. W. Hayden et al cited above.

Marya and Wyon, *Proceedings of the 4th International Conference on the Strength of Metals and Alloys,* Nancy France, Vol. 1, 1976, pp. 438–442 and Weill and Wyon, *Proceedings of the 5th International Conference on the Strength of Metals and Alloys,* Aachen, W. Germany, Vol. 1, 1979, pp. 387–392, have succeeded in making fine grained aluminum-gallium alloys superplastic at 50° C. by rubbing gallium on an aluminum surface and heat soaking the wetted aluminum at 50° C. for up to 50 hours. The invention is an alternative method for inducing superplastic properties in nonsuperplastic metal and alloy powders.

SUMMARY OF THE INVENTION

The invention is a method for inducing superplastic characteristics to nonsuperplastic metal and alloy powders. The method comprises mixing, in powder form, a nonsuperplastic material, metal or alloy with a second metal alloy having superplastic phase and melting temperature less than the nonsuperplastic material. The second alloy further has a eutectic or near eutectic composition and microstructure and none of its constituent elements significantly altering the properties of the nonsuperplastic material or cause embrittlement. Further, at least one of the constituent elements of the second alloy should be soluble and have high diffusivity in the nonsuperplastic material. The mixture of nonsuperplastic material and second alloy powders is then compacted under pressure and at a temperature either at or above room temperature to form a billet. The billet is rapidly heated to the melting temperature of the second alloy to uniformly disperse the second alloy proximate the grain boundaries of the nonsuperplastic material powders. The billet is then extruded or molded to the desired shape utilizing the superplastic properties of the second alloy disposed at the grain boundaries of the nonsuperplastic material particles. The formed article is subsequently heated to between 15° C. and 30° C. below the melting temperature of the second alloy to restore the grain boundaries of the nonsuperplastic alloy through the diffusion of the at least one constituent element of the second alloy into the nonsuperplastic material.

In an alternate process, the billet is first either warm extruded or molded into the desired shape. The formed billet is then heated to the superplastic state of the second alloy and densified, such as by sintering. The superplastic characteristics of the second alloy are utilized to achieve a dense product under low temperatures and pressures. The finished article is subsequently heated to a temperature 15° C. to 30° C. below the melting temperature of the second alloy to restore of the grain boundaries of the nonsuperplastic material by the diffusion of the at least one constituent element into the nonsuperplastic material particles.

The advantage of the disclosed method is that many nonsuperplastic metals or alloys can be made to appear as if they have a superplastic state. This apparent superplastic state permits these alloys to be formed into the desired shape using conventional extrusion and molding techniques at much lower temperatures and pressures. These and other advantages of the disclosed method will become apparent from a reading of the specification in conjunction with the drawings.

DETAILED DESCRIPTION OF THE INVENTION

The method of the invention uses at least two different metal powders. One powder is made from a base metal, either a pure metal or a metal alloy, desired to be formed and which does not possess superplastic properties. The other powder is made from a second metal alloy having a superplastic phase and the following additional characteristics:

1. The melting point of the second alloy should not be greater than the maximum temperature at which the base metal can be hot formed.
2. The second alloy should be of either a eutectic or a near eutectic composition and microstructure.
3. The second alloy should have high angle grain boundaries.
4. None of the constituent elements of the second alloy should significantly alter the properties of the base metal and/or cause alloy embrittlement.

5. At least one of the second alloy's constituent elements should be soluble and of high diffusivity in the base metal; and
6. The second alloy should not be contaminated by the processing environment.

Figure 1:
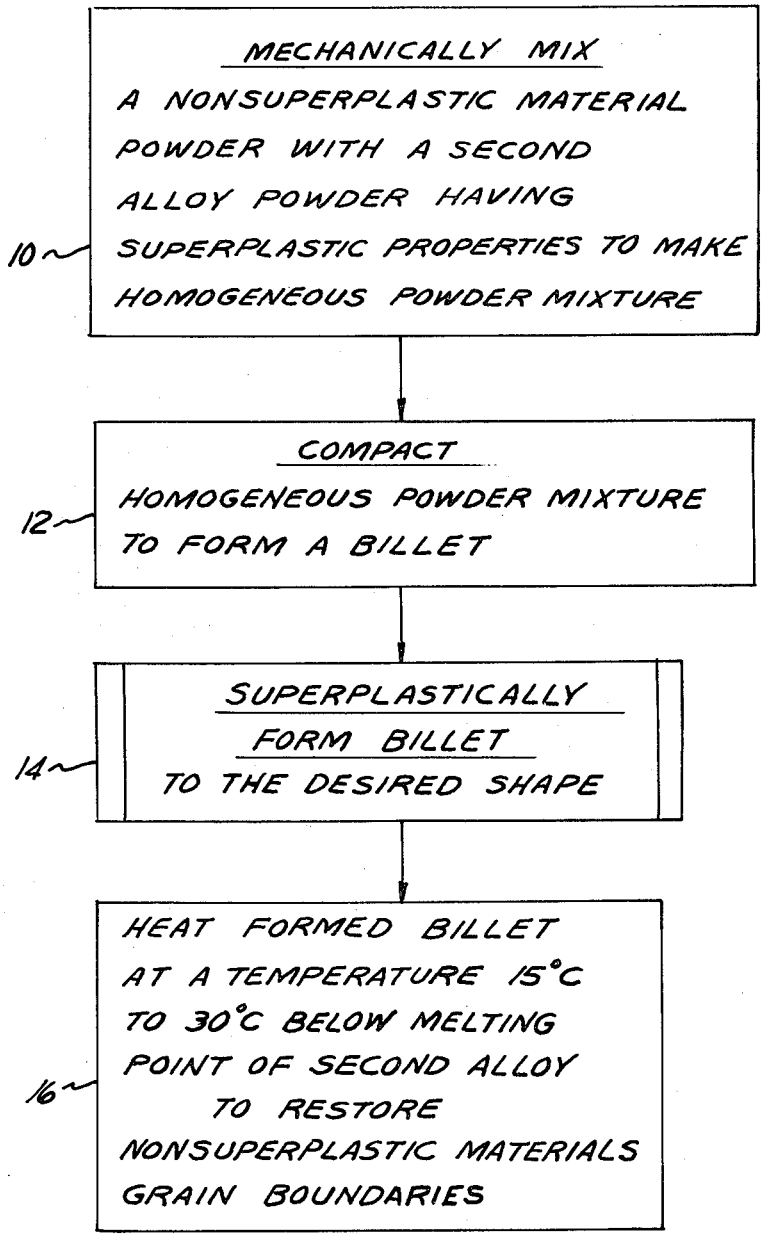
FIG. 1 is a flow diagram of the invented process.

Referring now to flow diagram shown on FIG. 1, a small quantity of the second alloy powder is added to the base metal powder and mixed to produce a homogeneous mixture of the two powders as indicated by block 10. The quantity of the second alloy powder added to the base metal powder is nominally 6 to 8 percent by volume however, lesser or greater quantities may be used. Preferably, the grain size of the second alloy should be under 10 micrometers and approximately 1/7 that of the base metal powder. When the mixing is performed in a high speed shaker or ball mill, the initial grain size of the second alloy may be in the range from 50 to 200 micrometers. The milling process will simultaneously mix the powders as required and refine the grain size of the second alloy to the desired size. The rate of grain refinement during the milling process is roughly logarithmic with milling time.

The powder mixture is then compacted at a temperature above ambient to form a billet as indicated by block 12. Both milling and compacting introduces strain energy into the system which acts as a driving force for subsequent forming and sintering processes. The billet is then superplastically formed to the desired shape as indicated by block 14. This may be done by either of the two alternative methods described with reference to the procedures shown by the flow diagrams of FIGS. 2 and 3.

The formed billet is subsequently heat soaked at a temperature from 15° C. to 30° C. below the melting temperature of the second alloy to define at least one of the elements of the second alloy into the base metal. By this process, most of the properties of the base metal grain boundaries are restored to their original state and the superplastic phase of the residual second alloy destroyed.

Figure 2:
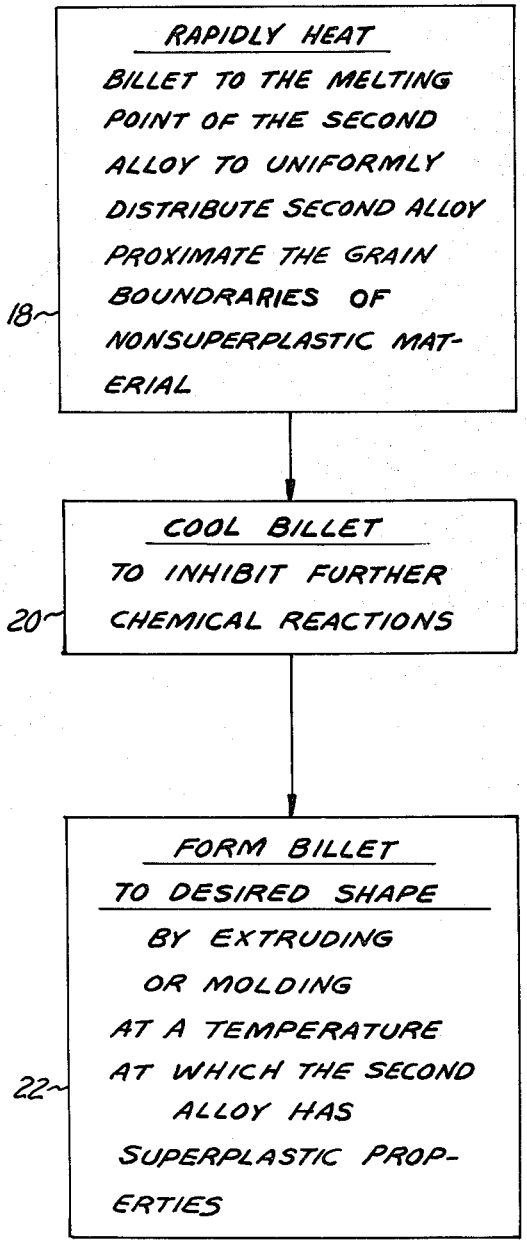
FIG. 2 is a flow diagram of a first method for superplastically forming and sintering an article from a billet.

As previously indicated with reference to block 14 of FIG. 1, there are at least two different methods for superplastically forming the billet into the desired shape. Referring to FIG. 2, there is shown a first method of superplastically forming the billet. In this method, the compacted billet is rapidly heated to the melting point of the second alloy as indicated by block 18. This causes the second alloy to be uniformly distributed at or near the grain boundaries of the nonsuperplastic alloy particles. The rapid heating of the billet may be performed with a scanning laser beam, a plasma arc, induction heating or any other method known in the art.

The billet is then cooled as indicated by block 20. The billet may be cooled to room temperature for temporary storage or cooled to the temperature at which the second material exhibits superplastic properties for immediate forming of the billet to the desired shape. The rapid cooling of the billet inhibits the chemical reaction between the second alloy and the particles of the base alloy preserving the superplastic properties of the second alloy. Where one of the constituent elements of the second alloy is readily soluble in the base metal and some of it will dissolve during this rapid heating process, the composition of the second alloy may contain an excessive amount of the soluble constituent such that after the rapid heating step, the residual second alloy will have the desired eutectic composition. The billet is then formed to the desired shape by conventional extrusion or molding techniques at the temperature at which the second alloy has superplastic properties as indicated by block 22. The superplastic properties of the second alloy proximate the grain boundaries of the nonsuperplastic material particles causes the billet to appear as if it was made from a superplastic material during the forming process.

As indicated by block 16 of FIG. 1, the formed billet is then heated to a temperature 15° C. to 30° C. below the melting point of the second alloy. At this temperature, the at least one element of the second alloy diffuses into the particles of the nonsuperplastic alloy and thereby effects a recovery of most of the grain boundaries of the nonsuperplastic material.

Figure 3:
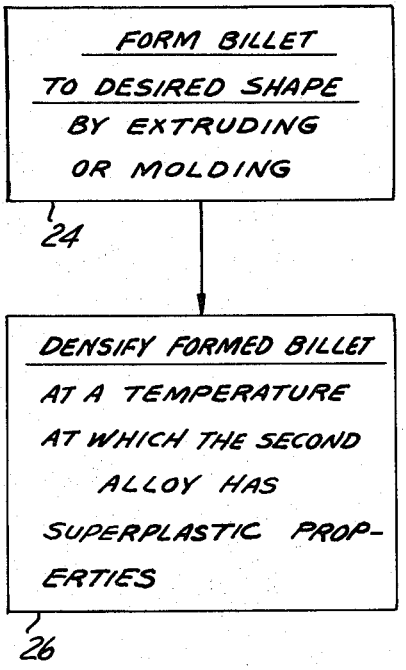
FIG. 3 is a flow diagram of an alternate method for superplastically forming and sintering an article from a billet.

The alternative method for superplastically forming the billet is shown on FIG. 3. In this method, the billet, after compacting, is warm extruded or molded to the desired shape using conventional techniques as indicated in block 24. The formed product is then densified at a temperature at which the second alloy has superplastic properties as indicated by block 26 using hot pressing or sintering techniques. The advantage of this processes over those used to densify nonsuperplastic powders is that the densification is accomplished at much lower pressures and temperatures.

Known second alloys having superplastic characteristics that may be used in combination with nonsuperplastic ferrous metals and/or alloys are listed below along with their melting points (M.P.):

(1) Aluminum—0.05% iron, eutectic; M.P. 335.5° C.
(2) Gallium—1.1% aluminum, eutectic; M.P. 26.7° C.
(3) Gallium—47% aluminum, eutectic; M.P. 217.8° C.
(4) Aluminum—17.5% indium, eutectic; M.P. 331.6%

Known second alloys having superplastic properties and their melting points, that may be used in combination with nonsuperplastic aluminum alloys are as follows:

(1) Aluminum—17.5% indium, eutectic; M.P. 331.6° C.
(2) Silver—32.3% aluminum, eutectic; M.P. 225° C.
(3) Galium—47% aluminum, eutectic; M.P. 217.8° C.
(4) Zinc—5% aluminum, eutectic; M.P. 194.4° C.

Similarly, second alloys having superplastic properties and their respective melting points which may be used in conjunction with copper alloys are:

(1) Tin—34% copper, eutectic; M.P. 274.4° C.
(2) Copper—39.1% germanium, eutectic; M.P. 337.8° C.
(3) Zinc—0.9% gallium, eutectic; M.P. 108.3° C.

For particular applications, it may not be possible to identify a second alloy readily soluble in the nonsuperplastic material. In these instances, a minimal quantity of the second alloy may be used. The second alloy should have properties close to those of the nonsuperplastic alloy.

The advantages of this method are:

(1) Many nonsuperplastic alloys can be made to appear as if they have superplastic properties.
(2) Nonsuperplastic alloys can be formed at reduced temperatures and pressures thereby reduce tooling requirements.
(3) The base or nonsuperplastic material does not have to have ultra-fine grain sizes.
(4) Eliminates the problems encountered during superplastic forming of materials having thermodynamically unstable superplastic structures.

(5) Processing detail can be adjusted to obtain the high angle grain boundaries required for superplastic forming.

It is not intended that the invention be limited to specific examples disclosed and discussed herein. It is submitted that there are many other superplastic alloys which can be used as second alloys for imparting superplastic properties to nonsuperplastic metals an alloys within the scope of the invention as described herein and set forth in the appended claims.

What is claimed is:

1. A method for superplastically forming nonsuperplastic metallic materials, comprising the steps of:

mixing, in powder form, a first quantity of a nonsuperplastic metallic material with a predetermined quantity of a second metal alloy having superplastic characteristics to form a homogeneous mixture;

compacting said homogeneous mixture to form a billet;

superplastically forming said billet to the desired shape; and heating said formed billet in a temperature range from 15° C. to 30° C. below the melting point of said second alloy to restore the grain boundaries of said nonsuperplastic material.

2. The method of claim 1 wherein said nonsuperplastic metallic material includes both metals and metal alloys.

3. The method of claim 1 wherein the grain size of said second alloy is less than 10 micrometers and said grain size is approximately 1/7 that of the nonsuperplastic material.

4. The method of claim 2 wherein said step of mixing includes the step of mechanically milling in powder form said first quantity of nonsuperplastic metallic material with said predetermined quantity of second metal alloy.

5. The method of claim 4 wherein said step of milling further refines the grain size of said second alloy from an initial grain size range from 50 to 200 micrometers to grain sizes of less than 10 micrometers.

6. The method of claim 1 wherein said second metal alloy is of a eutectic or near eutectic composition having a melting point lower than the melting point of said nonsuperplastic material.

7. The method of claim 6 wherein said second metal alloy has at least one constituent element soluble in said nonsuperplastic material and wherein said at least one constituent element does not significantly alter the properties of said nonsuperplastic material.

8. The method of claim 1 wherein said step of superplastically forming comprises the steps of:

rapidly heating said billet to the melting temperature of second metal alloy to uniformly distribute said second metal alloy proximate the grain boundaries of the nonsuperplastic material particles;

cooling said billet to inhibit further chemical reaction between said second metal alloy and said nonsuperplastic metallic material particles; and extruding said billet at a temperature at which said second alloy exhibits superplastic properties to form said billet to said desired shape.

9. The method of claim 1 wherein said step of superplastically forming comprises the steps of:

rapidly heating said billet to the melting point of said second alloy to uniformly distribute said second alloy proximate the grain boundaries of the nonsuperplastic material particles;

cooling said billet to inhibit further chemical reactions between said second alloy and the particles of the nonsuperplastic material; and molding said billet at a temperature at which said second alloy has superplastic properties to form said billet to said desired shape.

10. The second of claim 1 wherein said step of superplastically forming comprises the steps of:

extruding said billet to form said billet to said desired shape; and heating said formed billet at a temperature at which said second alloy has superplastic properties to densify the compacted homogeneous mixture.

11. The method of claim 1 wherein said step of superplastically forming comprises the steps of:

molding said billet to form said billet to said desired shape; and heating said formed billet at a temperature at which said second alloy has superplastic properties to densify the compacted homogeneous mixture.

12. The method of claims 10 or 11 wherein said step of heating includes the step of sintering.

13. The method of claim 6 wherein said step of superplastically forming comprises the steps of:

rapidly heating said billet to the melting temperature of said alloy to uniformly distribute said second metal proximate the grain boundaries of the nonsuperplastic material particles;

cooling said billet to inhibit further chemical reaction between said second alloy and said nonsuperplastic material particles;

extruding said billet at a temperature at which said second alloy exhibits superplastic properties to form said billet to said desired shape.

14. The method of claim 7 wherein said step of superplastically forming comprises the steps of:

rapidly heating said billet to the melting point of said second alloy to uniformly distribute said second alloy proximate the grain boundaries of the nonsuperplastic material particles;

cooling said billet to inhibit further chemical reactions between said second alloy and the particles of the nonsuperplastic material; and molding said billet at a temperature at which said second alloy has superplastic properties to form said billet to said desired shape.

15. The method of claims 13 or 14 wherein said step of rapidly heating includes the step of laser scanning said billet.

16. The method of claim 13 or 14 wherein said step of rapidly heating includes the step of heating said billet with a plasma arc.

17. The method of claims 13 or 14 wherein said step of rapidly heating includes the step of induction heating.

18. The method of claim 7 wherein said step of superplastically forming includes the steps of:

extruding said billet to form said billet to said desired shape; and heating said billet to a temperature at which said second alloy has superplastic properties to densify said homogeneous mixture.

19. The method of claim 7 wherein said step of superplastically forming includes the steps of:

molding said billet to form said billet to said desired shape; and heating said billet to a temperature at which said second alloy has superplastic particles to densify said homogeneous mixture.

20. The method of claim 18 or 19 wherein said step of heating includes the step of sintering.

21. A method for forming a billet having superplastic properties from nonsuperplastic metallic materials, comprising the steps of:

mixing, in powder form, a first quantity of a nonsuperplastic metallic material with a predetermined quantity of a second metal alloy having superplastic characteristics to form a homogeneous mixture;

compacting said homogeneous mixture to form a billet;

rapidly heating said billet to the melting temperature of said second alloy to uniformly distribute said second alloy proximate the grain boundaries of the nonsuperplastic material particles; and cooling said billet to inhibit further chemical reaction between said second metal alloy and said nonsuperplastic metallic material particles.

22. The method of claim 21 wherein said nonsuperplastic material includes both metals and metal alloys.

23. The method of claim 21 wherein the grain size of said second alloy is less than 10 micrometers and said grain size is approximately 1/7 that of the nonsuperplastic material.

24. The method of claim 22 wherein said step of mixing includes the step of mechanically milling in powder form said first quantity of nonsuperplastic metallic material with said predetermined quantity of second metal alloy.

25. The method of claim 24 wherein said step of milling also refines the grain size of said second alloy from an initial grain size range from 50 to 200 micrometers to grain sizes of less than 10 micrometers.

26. The method of claim 21 wherein said second metal alloy is of a eutectic or near eutectic composition having a melting point lower than the melting point of said nonsuperplastic material.

27. The method of claim 26 wherein said second metal alloy has at least one constituent element soluble in said nonsuperplastic material and wherein said at least one constituent element does not significantly alter the properties of said nonsuperplastic material.

* * * * *